US008109581B1

(12) United States Patent
Lazenby

(10) Patent No.: US 8,109,581 B1
(45) Date of Patent: Feb. 7, 2012

(54) METHOD AND APPARATUS FOR TRANSPARENT SHELVES AND DRAWERS FOR KITCHEN CABINETS

(76) Inventor: James W. Lazenby, Birmingham, AL (US)

( * ) Notice: Subject to any disclaimer, the term of this patent is extended or adjusted under 35 U.S.C. 154(b) by 0 days.

(21) Appl. No.: 12/928,925

(22) Filed: Dec. 23, 2010

Related U.S. Application Data

(63) Continuation-in-part of application No. 12/288,899, filed on Oct. 25, 2008, now abandoned.

(51) Int. Cl.
*A47B 88/00* (2006.01)

(52) U.S. Cl. ..... 312/311; 312/334.28; 312/330.1

(58) Field of Classification Search ..... 312/249.9, 312/249.11, 198–201, 334.28, 311
See application file for complete search history.

(56) References Cited

U.S. PATENT DOCUMENTS

| | | | | | |
|---|---|---|---|---|---|
| 463,932 | A | | 11/1891 | Allison | |
| 637,361 | A | | 11/1899 | Saters | |
| 827,649 | A | | 7/1906 | Murphy | |
| 1,281,923 | A | | 10/1918 | Fales | |
| 1,750,291 | A | * | 3/1930 | Whetstone | 312/334.26 |
| 1,798,800 | A | * | 3/1931 | Macknight | 312/198 |
| 2,915,195 | A | | 12/1959 | Crosby | |
| 2,923,584 | A | * | 2/1960 | Broderick, Jr. | 312/317.1 |
| 3,874,756 | A | | 4/1975 | Greene | |
| 4,084,125 | A | | 4/1978 | King | |
| 4,319,792 | A | * | 3/1982 | Britt et al. | 312/245 |
| 4,436,352 | A | | 3/1984 | Okada et al. | |
| 4,653,818 | A | | 3/1987 | De Bruyn | |
| 4,958,730 | A | * | 9/1990 | Bunten | 206/315.11 |
| 5,057,977 | A | | 10/1991 | Kurzman | |
| 5,069,512 | A | | 12/1991 | Sykes | |
| 5,671,987 | A | | 9/1997 | Hommes | |
| 5,779,067 | A | * | 7/1998 | Reaney | 211/90.04 |
| 5,813,735 | A | * | 9/1998 | Wu | 312/204 |
| 5,813,736 | A | | 9/1998 | Ballew | |
| 5,944,400 | A | | 8/1999 | Fulterer | |
| 5,992,956 | A | * | 11/1999 | Slivon | 312/334.25 |
| 6,027,190 | A | | 2/2000 | Stewart et al. | |
| 6,112,917 | A | * | 9/2000 | Baker et al. | 211/162 |
| 6,135,584 | A | * | 10/2000 | Happ | 312/330.1 |
| D437,706 | S | | 2/2001 | Alcala et al. | |
| 6,199,966 | B1 | | 3/2001 | Fulterer | |
| 6,220,682 | B1 | | 4/2001 | Vertullo | |
| 6,231,138 | B1 | | 5/2001 | Janson | |
| 6,398,322 | B1 | | 6/2002 | Chaplin | |
| 6,412,892 | B1 | | 7/2002 | Bonat | |
| 6,484,893 | B1 | | 11/2002 | Tkatch | |
| 6,530,627 | B2 | | 3/2003 | Elmer | |
| 6,682,159 | B2 | | 1/2004 | Compagnucci | |
| 6,845,721 | B1 | | 1/2005 | Doucet et al. | |
| 7,306,301 | B2 | | 12/2007 | Walburn | |

(Continued)

*Primary Examiner* — Darnell Jayne
*Assistant Examiner* — Andres F Gallego
(74) *Attorney, Agent, or Firm* — George L. Williamson

(57) ABSTRACT

A transparent rollout pantry organizing system for kitchen cabinets has at least two rollout shelf units that are constructed of planar clear sheet material that is cut and fused together to form a rigid structural shape with shelves having heavy duty drawer guides fastened to the rollout unit which can be extended out of the pantry cabinet so that items can be easily accessed, and having at least one pair of side by side drawers above the rollout units also made of clear material used for the rollout units. By using clear material, items on upper shelves can be seen through the drawer bottoms, and by using the drawers in pairs, items on upper drawers at the rear of the drawer can be easily accessed by extending one drawer at a time and reaching over the sides.

8 Claims, 6 Drawing Sheets

U.S. PATENT DOCUMENTS

2002/0140329 A1 10/2002 Compagnucci
2003/0067253 A1 4/2003 Kuo
2004/0066122 A1* 4/2004 Holmes ..... 312/311
2004/0232810 A1 11/2004 Kreyenkamp
2005/0001520 A1 1/2005 Cummings
2005/0231079 A1 10/2005 Rockcastle
2006/0119238 A1 6/2006 Sagel et al.
2007/0262683 A1* 11/2007 Creed ..... 312/290
2009/0179532 A1* 7/2009 Pan ..... 312/201
2010/0307939 A1* 12/2010 Schmitt ..... 206/315.11

* cited by examiner

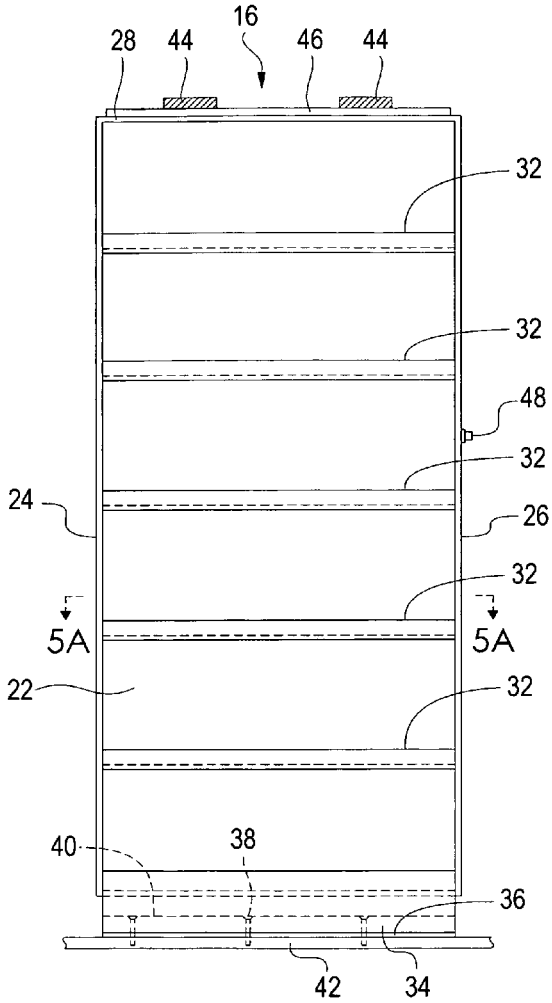
FIG. 4
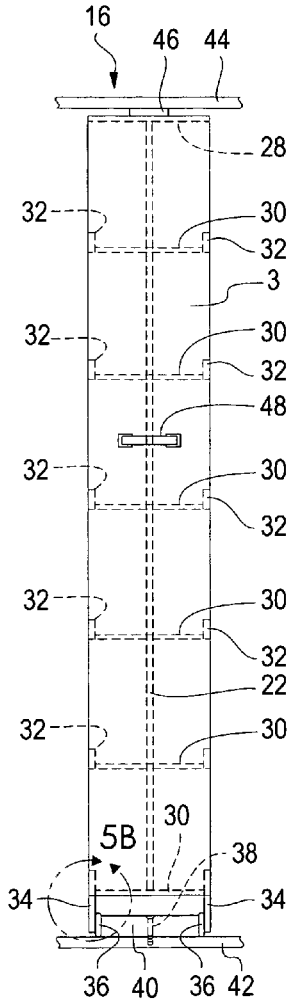
FIG. 5
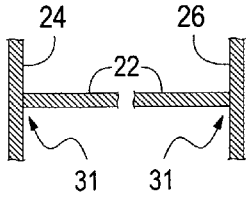
FIG. 5A
FIG. 5B
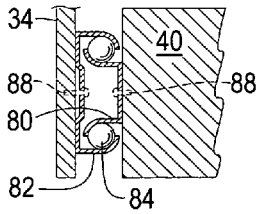

METHOD AND APPARATUS FOR TRANSPARENT SHELVES AND DRAWERS FOR KITCHEN CABINETS

RELATED APPLICATIONS

This application is a Continuation-in-Part of U.S. patent application Ser. No. 12/288,899 filed on Oct. 25, 2008 now abandoned.

BACKGROUND OF THE INVENTION

1. Field of the Invention

The present invention relates generally to cabinets and, more particularly, is concerned with a method and apparatus for transparent rollout cabinet drawers and shelves.

2. Description of the Prior Art

Tall pantry cabinets are typically designed with fixed shelves, full width rollout shelves, and multiple foldout door panels with shelves or individual rollout shelf units with individual cabinet panel fronts. In tall pantry cabinets using the aforementioned designs, the problems normally found are as follows: With fixed or even adjustable shelves, only the items in the front of a typical 24 inch deep cabinet can be seen or accessed very easily. When full width rollout shelves are used, it is difficult to see items near the rear as labels on cans, or other food items, are typically placed on the side of the items and when stored sitting upright the label is out of view because it is blocked by the items placed directly in front. It is also difficult to reach to the back of a full width rollout drawer once the drawer or shelf heights gets above shoulder height. Multiple foldout doors with shelving attached is also used but this system seems to waste space due to the amount of space taken up by the unit itself. It also is difficult to locate items in the unit without unfolding some if not all of the doors. The individual tall pantry units are typically 6 inches to 12 inches wide with either wood, metal or wire shelving and have individual cabinet door panel fronts, base, back sides, etc. Door panel fronts and cabinet doors are customarily the most expensive part of the cabinet and also each door unit must be fully extended to see the items in the unit. To have multiple units, cost would be high due to increased door and cabinet cost, and locating items would not be as easy as the present invention, as most items cannot be seen until each door panel is rolled out fully on those individual pantry units.

SUMMARY OF THE PRESENT INVENTION

The present invention is a transparent rollout pantry system designed to work with any cabinet makers tall pantry cabinets. These pantry cabinets are also referred to in manufacturer's brochures as tall storage or utility cabinets. This system can be used with rollout shelf units, with shelving on either one or two sides of a clear supporting panel and each unit typically would be 24 inches to 80 inches tall, 6 inches to 8 inches wide and 18 inches to 24 inches deep depending on cabinet manufacturer's specifications. Typically three to four rollout shelf units with either one or two sided shelving would be used with each pantry cabinet depending on its width. Two clear pullout side by side drawers at one or more levels can be used above the rollout shelves. The present invention is designed to work with any cabinet makers typical tall pantries which are 24 inches to 36 inches wide, 18 inches to 24 inched deep and up to 96 inches high.

The system is a combination of vertical rollout units made using any transparent material, such as acrylic, that can be cut and fitted together and then fused to make a strong, self supporting lightweight unit. Each unit is then supported with two heavy duty drawer guides placed at the base or top to carry vertical loads and at least one horizontal heavy duty guide at the opposite end to laterally stabilize the unit. Conventional drawer guides are used, and any conventional guide could be used that will carry the required load. By having a transparent unit and shelves only wide enough to typically support most pantry items, items stored are only one deep and can be easily seen without even rolling out a unit, and then can be easily reached by pulling out the appropriate unit containing the desired item. Clear rollout drawers are also part of the system and would be used in pairs above the rollout units. Drawers are used above rollout units in pairs as they have the advantage, by being clear, of seeing items through the bottom of the drawer, and by having the drawers in pairs, someone can extend one drawer at a time and reach to the back of each drawer from the sides, and this gives more drawer usage than full width conventional shelves. As mentioned earlier, full width rollout drawers above shoulder height make it difficult to access items at the rear of the drawer.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which:

FIG. 4 is a side view of a tall pantry cabinet rollout unit with shelves on two sides of a central divider support member.

FIG. 5 is a front view of FIG. 3, showing the shelves and stiffeners which can be seen through the front of the clear front panel.

FIGS. 5A and 5B are detailed cross-section view of portions of the present invention taken from FIGS. 4 and 5 as indicated.

LIST OF REFERENCE NUMERALS

Figure 1A:
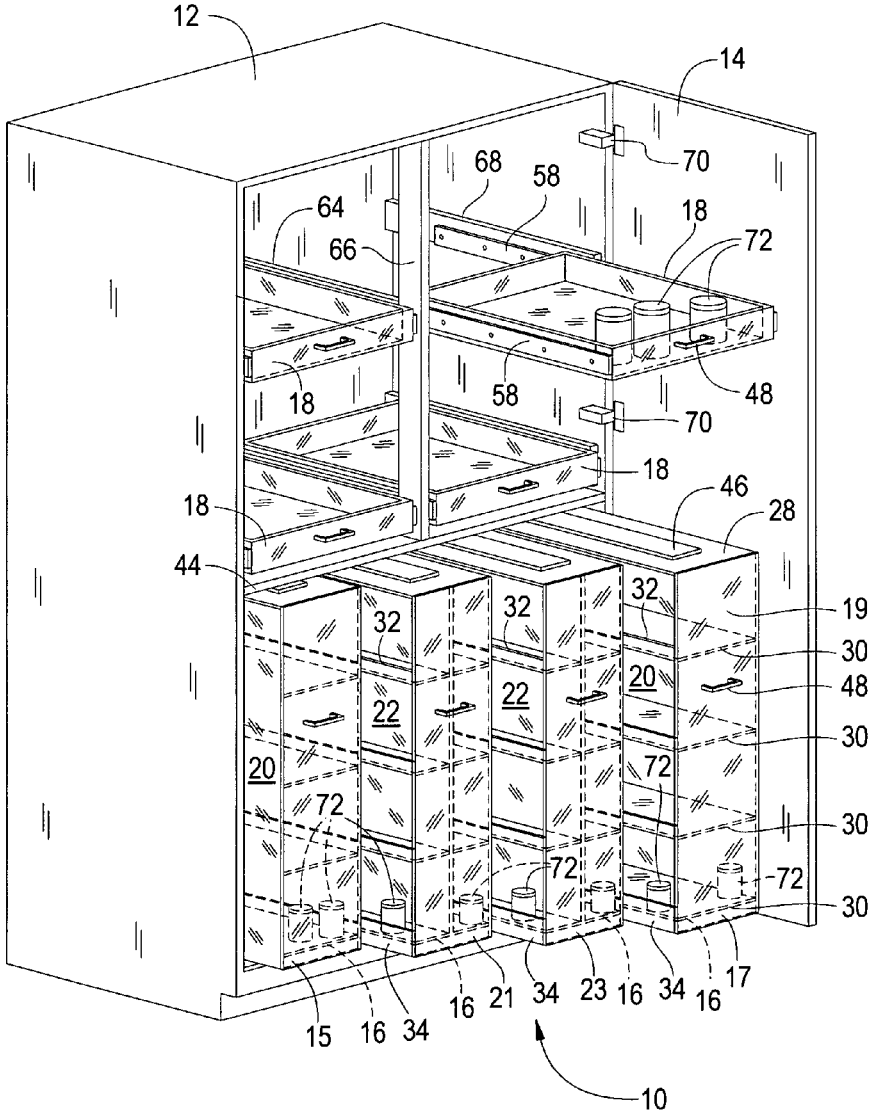
FIGS. 1A and 1B are perspective views of the present invention.

With regard to reference numerals used, the following numbering is used throughout the drawings.

| | |
|---|---|
| 10 | present invention |
| 12 | pantry cabinet |
| 14 | door |
| 15 | left outside unit |
| 16 | shelf unit |
| 17 | right outside unit |
| 18 | drawers |
| 19 | transparent acrylic |
| 20 | side support member |
| 21 | left inside unit |
| 22 | center support member |
| 23 | right inside unit |
| 24 | back shelf support |
| 26 | front shelf support |
| 28 | top panel |
| 30 | individual shelf |
| 31 | solvent welded joint |
| 32 | stiffener member |
| 34 | lower deep stiffener member |
| 36 | guides |
| 38 | fastener |
| 40 | block |
| 42 | cabinet interior floor |
| 43 | cabinet exterior bottom |
| 44 | strut |
| 46 | horizontal guide |
| 48 | handle |
| 50 | drawer bottom |
| 52 | drawer front |
| 54 | drawer side |
| 56 | drawer back |
| 58 | drawer guide |
| 60 | side of cabinet |
| 61 | top of cabinet |
| 62 | back of cabinet |
| 64 | center support member |
| 66 | vertical support |
| 68 | spacer strut |
| 70 | hinge |
| 72 | items for storage |
| 74 | support surface |
| 76 | buckling |
| 78 | side support |
| 80 | inner portion |
| 82 | outer portion |
| 84 | roller |
| 88 | fastener |

DETAILED DESCRIPTION OF THE PREFERRED EMBODIMENT

The following discussion describes in detail at least one embodiment of the present invention. This discussion should not be construed, however, as limiting the present invention to the particular embodiments described herein since practitioners skilled in the art will recognize numerous other embodiments as well. For a definition of a complete scope of the invention the reader is directed to the appended claims. FIGS. 1 through 9 illustrate the present invention wherein a method and apparatus for a system of rollout shelves and drawers for a kitchen pantry cabinet is disclosed.

Figure 6:
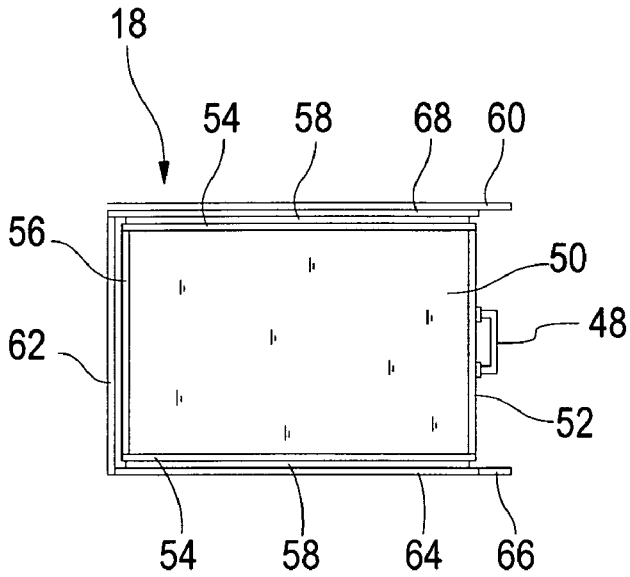
FIG. 6 is a plan view of a drawer.
Figure 7:
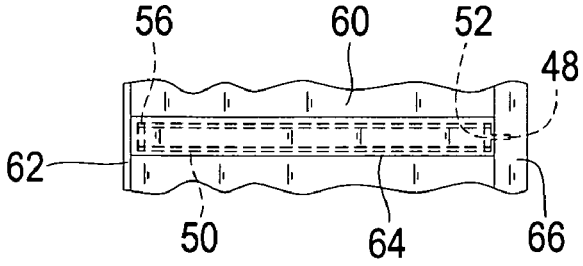
FIG. 7 is a side view of a drawer.
Figure 8:
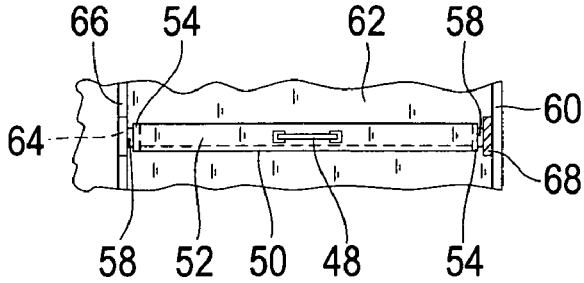
FIG. 8 is a front view of a drawer.

Turning to FIG. 1A, therein is shown the present invention 10 comprising a conventional kitchen pantry cabinet 12 having front side doors 14 with hinges 70 thereon (while only one right door is shown in this view for visual clarity, typically the cabinet would have a left and right door thereon). The present invention 10 comprises a system of rollout shelf units 16 (sometimes referred to herein as rollout units, rollout units of shelves, storage units, or rollout shelf units), and drawers 18 for a kitchen pantry cabinet 12 having doors 14 thereon comprising at least two rollout shelf units 16 as shown in FIGS. 2-5 and at least one pair of left and right hand drawer units 18 as shown in FIGS. 6-8. Each shelf unit 16 will contain at least one individual shelf 30 and may contain as many as four or more individual shelves as shown in FIG. 1A. All pieces of the rollout shelf units 16 and the drawers 18 are cut from clear planer acrylic 19 or other similar transparent material that can be fused together to make the structural connections between the pieces. Any method of fusing or solvent welding the pieces together would be acceptable so long as the joint was effectively strong such as would occur when solvent welding PVC pipe together using one or two part PVC cement or acrylic cement or the like. The lightweight clear material 19 used in the present invention 10 will not exceed ¼ inch in thickness and the strength of the units will be attained by fusing the pieces at carefully selected locations to form certain structural shapes, e.g, "L", "C" and "I", to increase the bending, shear and buckling loads of any of the individual pieces. Each rollout shelf unit 16 will not exceed 80 inches in height, 8 inches in width and 24 inches in depth so as not to exceed the load carrying capacity of the unit or heavy duty drawer guides 36 when loaded with items that typically are stored in kitchen pantry cabinets. Also shown are left 15 and right 17 of the outside drawers 16 and left 21 and right 23 of the inside drawers 16 along with an upper horizontal guide 46 and handle 48 on the outside surface of shelf unit 16 and drawer 18. Also shown are drawer guides 58 for drawers 16, support or strut 44, center support or strut 64, vertical support or strut 66, and strut 68 on the inside of the side wall of the cabinet 12. Also shown are the side support members 20, center support members 22, stiffener members 32 and lower stiffener members 34. Also shown are a few exemplary food items 72 being stored inside the drawers 18 and shelves 16.

Figure 1B:
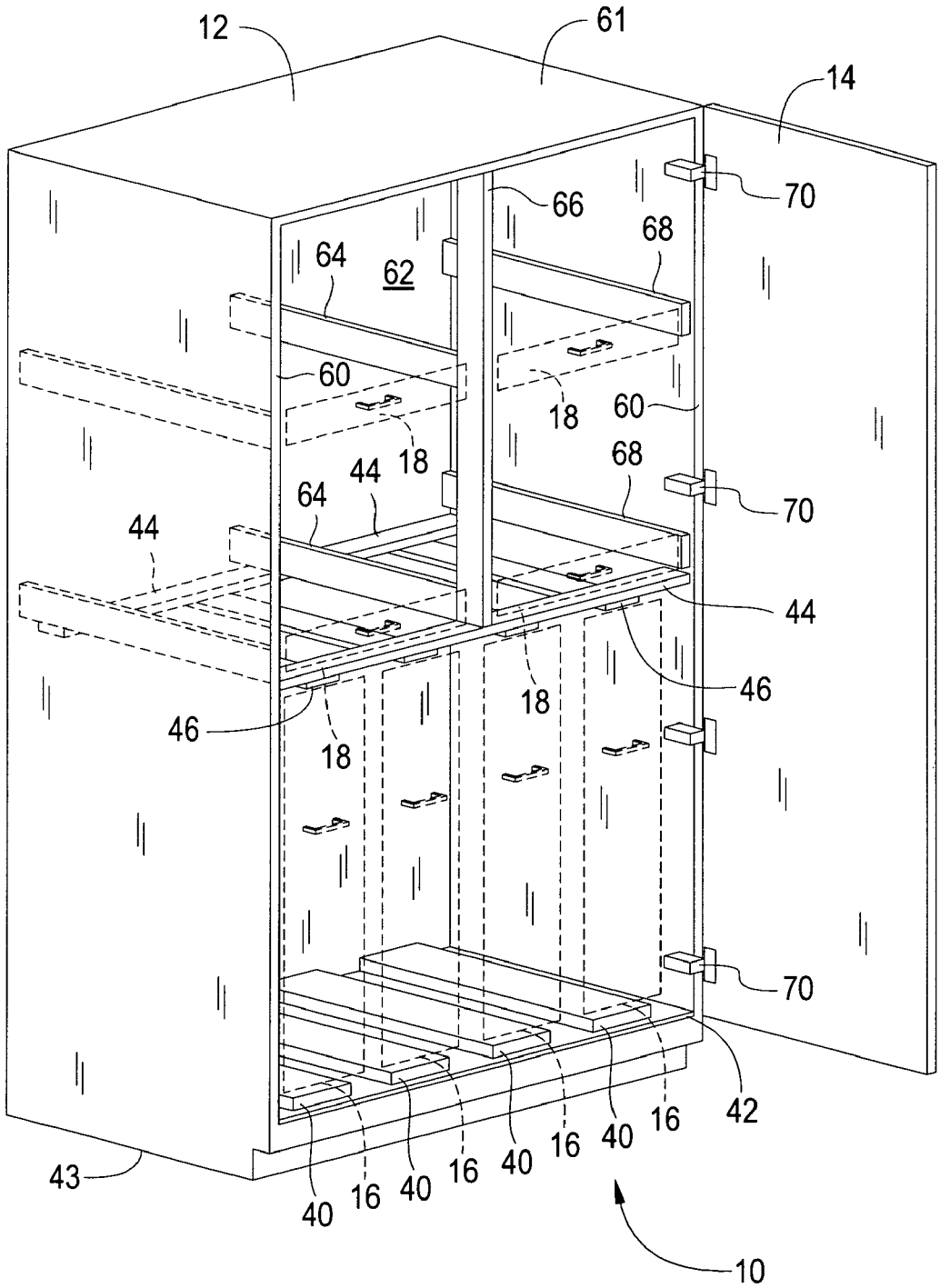

FIG. 1B is similar to FIG. 1A but shows additional details including block 40, horizontal guide 46 on top of each drawer 18, cabinet side 60, top 61, back 62, interior bottom 42 and the bottom 43 of the exterior of cabinet 12 which would be in contact with the supporting surface such as a floor of a building. Also shown are supports or struts 44, 64, 66 and 68 on the inside of the walls of cabinet 12. Drawers 18 are shown in phantom. All references to the left/right sides and other sides of the cabinet 12, drawers 18, shelves 16 and/or other portions of the present invention 10 herein would correspond to those referenced in FIGS. 1A and 1B.

Figure 2:
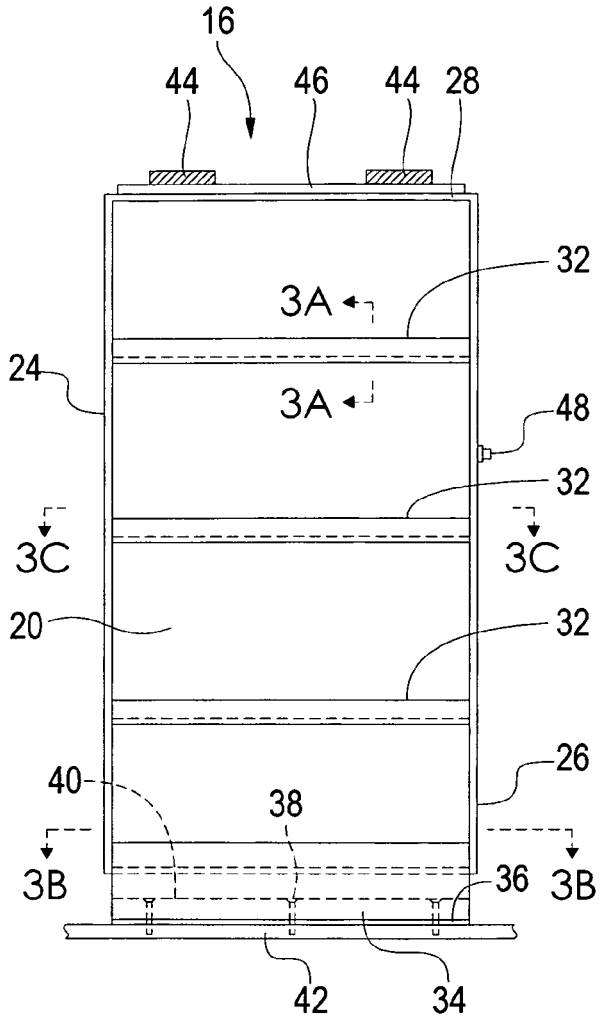
FIG. 2 is a side elevation view of a tall pantry cabinet rollout unit with shelves on one side of a side support member.
Figure 3:
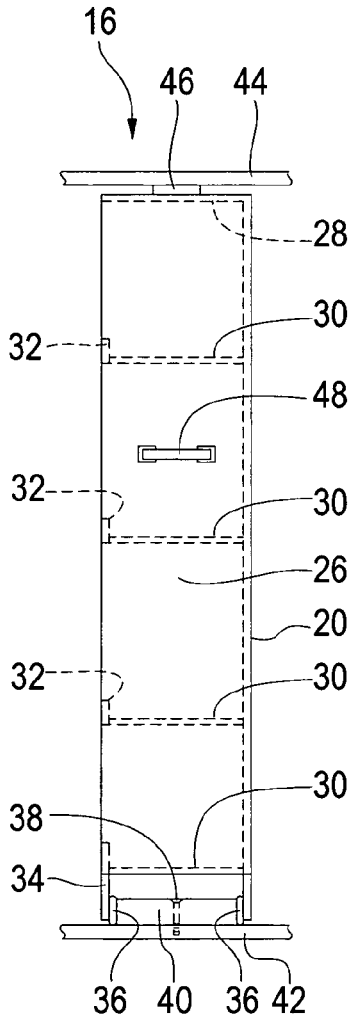
FIG. 3 is a front view of the shelves of FIG. 1.

Turning to FIGS. 2-3 therein is shown a shelf 16 having a solid side support panel or member 20 of a typical outside unit 16 of the system (while only a right side shelf is shown, there would also typically be a left side shelf as shown in FIG. 1A). Left 15 and right 17 outside units are shown in FIG. 1A being on the outside of the two inner or inside units one each being on the left 21 and right 23. FIGS. 4-5 illustrate a solid center support panel or member 22 for the inside unit 16 being one on the left 21 and right 23 as shown in FIG. 1A.

Figure 3A:
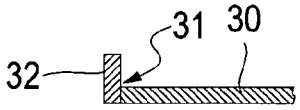
FIGS. 3A, 3B and 3C are detailed cross-section views of portions of the present invention taken from FIG. 2 as indicated.
Figure 3B:
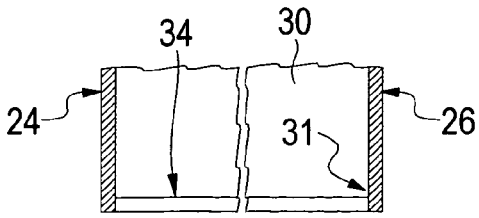
Figure 3C:
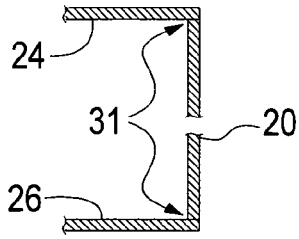

FIG. 3A shows a first stiffener 32 and an individual shelf floor 30 being fused or having a solvent welded joint at 31. FIG. 3B shows a second lower deep stiffener 34 attached to inner surface of the front 26 and rear 24 shelf support and edge of the floor of a shelf. FIG. 3C shows substantially a "C" Channel formed by the fusion of side support member 20, front panel 26 and back panel 24.

Turning to FIGS. 2-5 therein is shown the back shelf support panel 24, the front shelf support panel 26, the top support panel 28 on which the stabilizing drawer guide 46 is mounted, a typical floor of an individual shelf 30, a stiffener piece 32 for the edge of the shelf which when fused makes a composite "L" angle shaped beam (see FIG. 3A) that materially strengthens the system, including but not limited to, the individual shelves 30 and main support members 20, 22, and also serves as a stop to keep items from falling off the shelf if someone rolls the shelf in a reckless manner. Calculations indicate that an un-stiffened individual shelf 30 would have to be approximately ½ inch thick in order to have the same strength, i.e., deflection, as an individual shelf designed according to the teachings of the present invention 10 and would weight approximately 1.87 times more per unit of individual shelf which evidences the advantages of the present invention. Also shown is a lower deep stiffener member 34 that when fused to the bottom outside edge of the floor of a shelf and the inner surfaces of the front and back pieces (see FIG. 3B) make a strong composite section that is used to mount drawer guides 36 to the unit. Typically, two conventional supporting heavy duty drawer guides 36 on each side of a unit carry the vertical load of the unit. Also shown is fastener 38 that fastens the solid block 40 which can be wood, metal or the like, and which runs the length of the cabinets, and, supports portions of the drawer guides 36 for a shelf unit and which block is attached to the cabinet bottom or floor 42 on the interior of the cabinet 12 (not shown see FIG. 1B). Strut 44 or cross member is used to fasten the horizontal drawer guide 46 thereto which guide is then fastened to the top of the rollout shelf unit 16 which helps stabilize them in the vertical plane. A conventional handle 48 is also shown.

FIG. 5A shows substantially an "I" beam-like channel formed by the fusion of front panel 26, center support member 22 and back panel 24.

FIG. 5B shows an exemplary installation and an exemplary conventional drawer guide 36, 58 having inner 80 and outer 82 housings or portions, upper and lower ball bearings 84, wherein each portion uses a fastener 88 for attachment to a block 40 and stiffener 34 as, e.g., would be seen in FIG. 5.

Turning to FIGS. 6, 7 and 8 therein is shown a right-hand side clear, rollout drawer 18. A left side drawer 18 would essentially be a mirror image of the drawer 18 shown in FIGS. 6, 7 and 8. Shown is a conventional pull handle 48, a clear drawer bottom 50 that is easy to see through and can be cut and fused together to make a strong lightweight drawer unit, the clear drawer front 52, the clear drawer sides 54 and the clear drawer back 56, and the drawer guides 58 (guides 36 and 58 may be the same or different type of guide). Also shown is the side 60 of the cabinet which will support the drawer on one side. The back 62 of the cabinet will support the center support strut member or piece 64 for the left and right hand drawers 18. Also shown is a vertical support 66 at the front edge of the cabinet that supports the front end of member 64. Also shown is a spacer support strut 68 attached to the side 60 of the cabinet. The support pieces 64, 66, 68 and 44 (not shown, see FIG. 1A) are expected to be made of metal, wood or acrylic or similar material. Various combinations of the rollout shelf units 16 can be used with different pantry cabinets 12 (not shown, see FIG. 1A) depending on the width of the cabinet, and whether the doors 14 open fully to let items be accessed from both sides of a center supported rollout shelf unit, such as shown as item 22 in FIGS. 4 and 5. This type rollout shelf unit 16 is used for all intermediate units of the system and can be used for the outside rollout shelf units of the system if the doors 14 (not shown, see FIG. 1A) open fully. However, some pantry cabinets 12 use concealed hinges that let doors 14 open to just over ninety degrees and this type pantry cabinet would be better served using the side supported rollout shelf units as shown as item 20 in FIGS. 2 and 3, as items would be hard to access from the outside due to the doors if the rollout shelf unit of FIGS. 4 and 5 were used. This system of rollout shelf units 16 and pairs of drawers 18 maximize the storage capacity of the pantry cabinet 12 and let all items in the cabinet be seen and accessed easily.

Figure 9A:
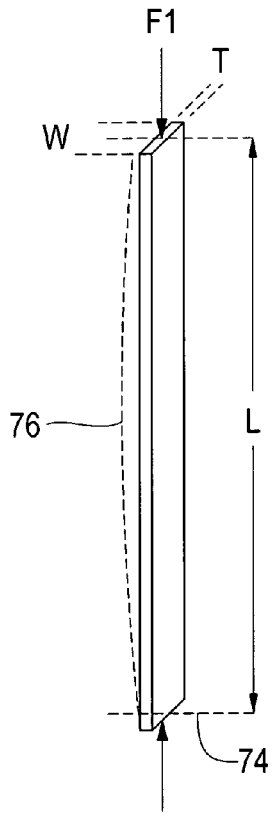
FIGS. 9A-9C is an illustration of a load test procedure related to the present invention.
Figure 9B:
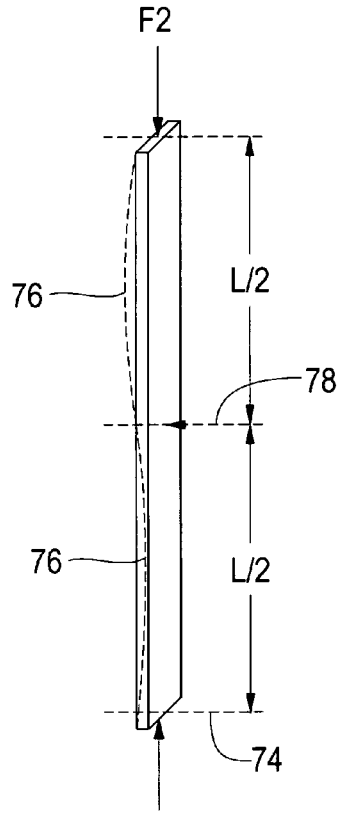
Figure 9C:
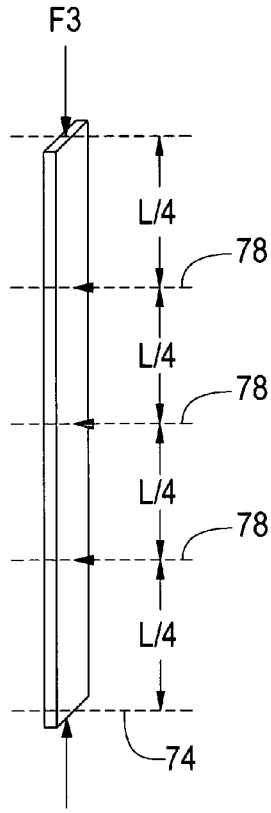

Turning to FIGS. 9A-9C, therein are shown the results of load testing of three identical, typical acrylic columns/beams as used and taught by the present invention, e.g., item 20, 22 in FIGS. 3 and 5. Each of the three columns shown in FIG. 9A-9C are 5.0 inch wide (shown as W), 0.20 inches thick (shown as T) and 52 inches long (shown as L). (The present invention teaches that its lightweight Plexiglas or acrylic column structural members, e.g., item 20, 22 in FIGS. 3 and 5, are defined as being less than or equal to 0.25 inches). The lower end of each column was placed on a support surface 74 and the buckling, if any, due to the load applied on the upper end of the column could be observed at 76. The buckling was visually observed for three different loads placed on the upper end of the columns and with side supports 78 being applied as indicated. Three different loads 5 lbs. (shown as F1 on FIG. 9A), 15 lbs. (shown as F2 on FIG. 9B) and 70 lbs. (shown as F3 on FIG. 9C) were applied. The side supports 78 are equivalent to support that the shelf floors 30 (See FIG. 3) would provide as taught by the present invention. In summary, the test results indicate that the columns buckled when the spans were long when compared to the thickness as seen in FIGS. 9A and 9B; however, the columns did not buckle when the spans were short when compared to the thickness as seen in FIG. 9C which is taught by the present invention 10 as shown in FIGS. 3 and 5.

The following additional detailed explanation is offered of the present invention 10 and may make reference to each of the FIGS. 1-9. The present invention 10 comprises: A) A rollout system of two types of pantry units of a clear light weight material 19, such as acrylic, that can be cut and fused together to make at least two rollout shelf units 16 that can be used with at least one pair of drawers 18 above and one of the rollout units being comprised of a front 26 and back 24 support piece of substantially the same height and width and a solid center support panel 22 which is a solid center support panel of substantially the same height as the front and back pieces minus two times the thickness of the material so that when the solid center support panel is fused to the front and back pieces the solid center support panel will be one material thickness below the top of the front and back pieces to allow the top and bottom pieces to fit flush with the top and bottom of the front and back pieces and after fusing the solid center support panel 22 to the front and back pieces this will form an I shaped column as viewed from the top and this column shaped piece will have a top piece 28 and a bottom piece 30 that will be substantially the same length as the horizontal dimension of the solid center support panel, and the top piece which will be fused to the front back and solid center support panel will be the same width as the front and back pieces and the bottom piece which will be fused to the front back and solid center support panel, will be the same width as the front and back pieces minus two times the thickness of the material used so that the two deep stiffener pieces 34 which will be substantially the same length as the bottom piece, and the width of the deep stiffener pieces will be the width of the heavy duty drawer guide 36 plus the width of the stiffener pieces, and the deep stiffener pieces planar sides are placed parallel to the solid center support panel, and the deep stiffener pieces are fused to the longitudinal edges of the bottom piece and to the front and back pieces, so that the deep stiffener pieces extend below the bottom of the bottom pieces by the width of the heavy duty drawer guides, and above the bottom of the bottom piece the same height as the stiffener pieces extend above the bottom of the intermediate shelves, and there will be at least one intermediate shelf on each side of the solid support center panel and the intermediate shelves will be substantially the same length as the top and bottom pieces and the sum of the widths of the intermediate shelves on each side of the solid support center panel plus three material thicknesses is substantially equal to the width of the front and back pieces, so that the stiffener pieces outside planar face is substantially flush with the vertical edges of the front and back pieces, and the intermediate shelves are fused to the solid center support panel, the front and back pieces and to the stiffener pieces, whose length is substantially the same length as the intermediate shelves, and the stiffener pieces lower edge will be flush with the bottom of the intermediate shelves and have enough height to act as a stop to keep items placed on the shelves from falling off the shelves when the rollout unit is extended or retracted, and will also be high enough to that when fused to the intermediate shelf it will form a L shaped structural section 32 and develop enough shear at the joint to make the composite shape carry more bending moments than either the flat shelf by itself or the stiffener by itself and since the intermediate shelf and stiffener are fused to the solid support panel and the front and back pieces, these intermediate shelves stiffen the solid support panel and the front and back pieces the same as a web stiffener on a steel column, to eliminate buckling of these pieces, which allows the rollout unit to carry more load than it would carry if it was not fused, as pieces of this thickness of acrylic are too thin for being joined by screws or bolts and thus are hard to join and develop the shear across the joints by other methods, such as screws or bolting, which will be used only to fasten the heavy duty drawer guides, whose flat sides are parallel and fit flat against the inside planer sides of the deep stiffener pieces, and there will be at least two binding posts with slotted screws sized to fit the heavy duty drawer guides, and the binding posts and screws will attach the extendable piece of the heavy duty drawer guides to the deep stiffener pieces and the fixed piece of the heavy duty drawer guides will be fastened to a wood or metal block or base 40 piece that is substantially the same length as the top and bottom piece, the same width as the bottom piece minus the thicknesses of the two heavy duty drawer guides, and the base piece thickness is substantially the same as the width of the heavy duty drawer guides, and the base piece is fastened to the cabinet floor or cabinet shelf with at least two bolts at front of back or screws 38 or the like that are countersunk flush with the top of the base piece and the bottom edge of the heavy duty drawer guides bear on the cabinet floor 42 or cabinet shelf, and the fixed piece of the heavy duty drawer guides are screwed or bolted to the base piece with at least two fasteners or the like, and the rollout unit deep stiffener pieces, when bolted to the heavy duty drawer guides will clear the cabinet floor or cabinet shelf with enough margin to not touch the cabinet floor panel, and the bottom of the bottom piece of the rollout unit will clear the top of the base piece when the rollout unit is extended or retracted, and there is a horizontal heavy duty drawer guide 46 fastened longitudinally to the top of the top piece 28 of the rollout unit 16 to laterally stabilize the rollout unit, and the heavy duty drawer guide has its flat extendable side against the top of the top piece so that it can be fastened to the top piece with bolts, and the fixed side of the heavy duty drawer guide will be fastened to two wood, metal or acrylic struts 44 that are near the front and back of the cabinet, and these struts fasten to the sides 60 of the pantry cabinet 12 to support the heavy duty drawer guide, and the rollout unit has a cabinet knob or pull handle 48 fastened to the front piece 26 of the rollout unit at a convenient height to pull the rollout unit out to an extended position, and this rollout unit when complete is designed to carry items that are placed on shelves only one deep on each side of a solid support panel with the ability to see and easily access any item when the rollout unit is extended. B) There is a second type rollout unit which could be used when the kitchen pantry cabinet doors cannot be opened fully to let items on the first type rollout unit be accessed easily, and this rollout unit has a front and back piece of substantially the same height and width and a solid side support panel 20 that connects between the front 26 and back 24 pieces at the edge being fused one material thickness below the top of the front and back pieces at the top, and extending below the bottom of the front and back pieces by the width of the heavy duty drawer guide, and when fused together these three pieces form a structural column "C" channel shape viewed from the top and there is a top piece and a bottom piece of substantially the same length, and both the front piece and the back piece are slightly shorter than the vertical dimension of the solid side support panel, and the top piece is the same width as the front and back pieces, and is fused to the front back and solid side support panel at the joining edges, and the bottom piece is the width of the front and back pieces minus two times the thickness of the material used, and the bottom of the bottom piece is flush with the bottom of the front and back pieces, and the bottom piece is fused to the front back and solid side support panel, and there is a deep stiffener piece substantially the same length as the bottom piece, whose planar side is parallel to the solid side panel and extends below the bottom of the bottom piece the width of the heavy duty drawer guide, and above the bottom of the bottom piece the same height as the stiffener piece extends above the bottom of the intermediate shelves, and the deep stiffener piece is fused to the edge of the bottom piece and to the front and back pieces, and there will be at least one intermediate shelf that is substantially the same length and width as the bottom piece, and the intermediate shelf is fused to the front, back and solid side support panel, and to a stiffener piece at the outside edge of the intermediate shelf, whose length is the same as the length of the intermediate shelf and whose planar side is parallel to the solid side support panel, and the bottom edge of the stiffener piece is flush with the bottom of the intermediate shelf, and has a minimum height above the shelf to act as a stop to keep items that are placed on the shelf from falling off the shelf when this rollout unit is extended or retracted, and this stiffener will also be high enough, so that when fused to the intermediate shelf it will form an L shaped piece 32 that structurally will carry more bending moment than either the flat shelf by itself, or the stiffener by itself, and the intermediate shelf and stiffener by being fused to the solid side support panel and back and front pieces, stiffen the solid side support panel and back and front pieces the same as web stiffeners on a steel column, to eliminate buckling of these pieces, which allows the rollout unit to carry more load than it would carry if it was not fused, as pieces of this thickness and this type material would be difficult to join and develop the shear across the joint by other methods such as bolting, which will be used only to fasten the heavy duty drawer guides, and one guide is fastened to the inside of the deep lower stiffener piece 34, and the deep stiffener piece is at the open side of the rollout unit and the other heavy duty drawer guide is fastened to the inside lower portion of the solid side support panel, which is extended below the bottom of the bottom piece, by the width of the heavy duty drawer guide, and acts the same as the other deep stiffener piece, to which the extendable piece of the heavy duty drawer guide is bolted and the solid support panel and the deep stiffener piece are bolted to the heavy duty drawer guides with at least two binding posts with slotted screws or the like sized to fit the heavy duty drawer guides, and the fixed piece of the heavy duty drawer guides are fastened to a wood or metal base piece 40 that is substantially the same length as the bottom piece, the same width as the bottom piece minus the thickness of two heavy duty drawer guides, and the base piece extends up above the cabinet floor or a cabinet shelf with enough height to substantially fasten the fixed side of the heavy duty drawer guides, and the base piece will be fastened to the cabinet floor or to a cabinet shelf with at least two bolts or screws or like fasteners 38 that are countersunk flush with the top of the base piece, and the bottom edge of the heavy duty drawer guides bear on the cabinet floor 42 or a cabinet shelf and the fixed piece of the heavy duty drawer guides are screwed or bolted to the base piece with at least two fasteners, and the rollout unit deep stiffener pieces when bolted to the heavy duty drawer guides will clear the cabinet floor or cabinet shelf with enough margin to not touch the cabinet floor or cabinet shelf, and the bottom piece of the rollout unit will clear the top of the base piece when the unit is extended or retracted, and there is a heavy duty drawer guide fastened longitudinally to the top of the top piece of the rollout unit to laterally stabilize the rollout unit, and the heavy duty drawer guide has its flat extendable side against the top of the top piece so that it can be fastened to the top piece with bolts, and the fixed side of the heavy duty drawer guide will be fastened to two wood, metal or acrylic struts that are near the front and back of the cabinet, and these struts fasten to the sides of the pantry cabinet to support the heavy duty drawer guides, and the rollout unit has a cabinet knob or pull handle fastened to the front piece of the rollout unit at a convenient height to pull the rollout unit out to an extended position. C) There will be at least one pair of side by side drawers 18 made from the same material as the rollout units and each drawer will have a front 52 piece and back 56 piece of substantially the same length and two side pieces of substantially the same length, and the front, back and side 54 pieces will be fused together with floor 50 and these four pieces of the drawer will be substantially the same height, and will be high enough to attach the heavy duty drawer guides 58, and structurally carry the loads placed in the drawer bottom when it is fused inside the box structure with its bottom flush with the bottom edge of the vertical pieces formed by the front, back and two side pieces, and the length of the drawer bottom and side pieces will substantially be equal to the length of the top piece 28 of the rollout unit, and the drawer front and back pieces will be of such length that the sum of their lengths plus the thickness of two heavy duty drawer guides plus a central support strut 64 that supports the two inside heavy duty drawer guides will be equal to the distance between the outermost edges of the two outside rollout units that will be located below, and the central support piece will be sized as small as possible in width to support the heavy duty drawer guides structurally, so as to maximize the drawer widths, and this central support strut will attach to a vertical strut 66 at the front of the cabinet 12 that attaches to the top 61 of the pantry cabinet, and to the front horizontal strut 44, that is supporting the top heavy duty drawer guides 46 of the rollout shelf units 16, and this central support strut also attaches to the back 62 of the pantry cabinet, and the outside of the left hand and right hand pair of drawers have a heavy duty drawer guide that is fastened to a wood strut 68, that is fastened to the side 60 of the pantry cabinet, and this strut extends from front to back of the rollout units, and the strut is substantially the same height as the width of the heavy duty drawer guides, and the thickness of this strut plus the thickness of the heavy duty drawer guide is substantially equal to the distance between the side wall of the pantry cabinet and the outside edge of the outermost rollout unit on the same side of the cabinet, and the extendable side of the heavy duty drawer guides attach to the drawer sides with binding posts and slotted screws or the like, and the fixed side of the heavy duty drawer guides fasten to the struts with bolts or screws or the like, and there will be a cabinet knob or pull handle 48 on the front of each drawer to move the drawer to an extended or retracted position.

As previously stated concerning the expected material of construction of the present invention 10, all pieces of the rollout shelf units 16 and the drawers 18 are cut from clear planer acrylic 19 or other similar transparent material that can be fused together to make the structural connections between the pieces. The material referred to herein as acrylic is polymethyl methacrylate (PMMA) which is a transparent thermoplastic, often used as a light or shatter-resistant alternative to glass. It is sometimes called acrylic glass. Chemically, it is the synthetic polymer of methyl methacrylate. PLEXIGLAS, POLYCAST, and LUCITE are brands of high grade acrylic. Acrylic is colorless and highly transparent, the solid material has high dimensional stability and good resistance to weathering and shock. It is used in aircraft canopies and windows, in boat windshields, and as a general alternative to glass in many applications. An object made of acrylic has the unusual property of keeping a beam of light reflected within its surfaces and thus carrying the beam around bends and corners. It is known that acrylic has a flexural strength of approximately 15,000 psi; therefore the flexural loads or stresses relative to the present invention are expected to be kept under 1,500 psi which is a safety factor of 10:1 so as to prevent creep and to limit long term deflection.

I claim:

1. A kitchen cabinet comprising:

a) said kitchen cabinet having a top wall, a bottom wall, side walls, and front opening doors;

b) within said kitchen cabinet, an upper section and a lower section;

c) said upper section having multiple pull out horizontal drawers, each drawer having a front and rear wall, each said front and rear wall being complementarily sized and shaped and being substantially upstanding, each said front and rear wall being rectangular shaped and having an upper end, a lower end, a first left side, a second right side, an inner surface and an outer surface, a left side wall and a right side wall extending between said front wall and said rear wall, a bottom being disposed in said drawer adapted to store a plurality of containers on said bottom, said bottom being disposed underneath said front, said rear, said left side and said right side walls; a slide mechanism being disposed on each of said left and right side walls of said drawer so that said drawer is slidably disposed in the cabinet; and wherein said drawer is constructed of transparent material adapted for visual observation of said containers through said transparent material via said bottom prior to sliding out the drawer;

d) said lower section comprising at least two vertically extending shelf units, each said shelf unit having a front and rear panel, each said front and rear panel being complementarily sized and shaped and being substantially upstanding, each said front and rear panel being rectangular shaped and having an upper end, a lower end, a left side, a right side, an inner surface and an outer surface;

e) a center support panel extending between said front and rear panels of each of said shelf units, said center support panel having upper and lower ends, wherein said center support panel and said front and rear panel of said shelf units form a substantially "I" shaped column when viewed from the top;

f) in said shelf units, a top panel disposed on said upper end of said front, said rear, and said center support panels, wherein said top panel extends from said front panel to said rear panel and from said first side to said second side of said front and rear panels;

g) in said shelf units, a bottom panel disposed on said lower end of said front, said rear, and said center support panels, wherein said bottom panel extends from said front panel to said rear panel and from said first side to said second side of said front and rear panels;

h) in said shelf units, at least one individual shelf being disposed on each side of said center support panel between said top and bottom panels so that a plurality of containers are adapted to be stored on said individual shelf, said individual shelf having an outer edge;

i) in said shelf units, a slide mechanism being disposed on each of said first and second sides of said bottom panel so that said shelf unit is slidably disposed in the cabinet;

j) in said shelf units, a first stiffener being connected on said outer edge of each individual shelf on said outer edge of each said individual shelf, wherein said first stiffener extends from said front panel to said rear panel, and is directly attached to both said front and rear panels, wherein said first stiffener and said individual shelf form a substantially "L" shaped beam on said left side of said front panel when viewed from the front, wherein said first stiffener is effectively high to form a lip to contain said containers on said individual shelf;

k) in said shelf units, wherein said front and rear panel, said center support panel, said top and bottom panels and individual shelves are constructed of said transparent material, wherein said containers are adapted to be visually observed through said transparent material prior to sliding out the shelf unit; and l) wherein all of said shelves in both said upper and lower sections are fused to said side walls and said central panels; and m) wherein said front opening doors of said cabinet completely enclose said upper and lower sections when closed.

2. The kitchen cabinet of claim 1, further comprising a second stiffener being disposed on said outer edge of said bottom panel, wherein said second stiffener extends from said front panel to said rear panel, wherein said second stiffener is effectively high to provide a vertical surface to which said slide mechanism is attached.

3. A kitchen cabinet comprising:

a) said kitchen cabinet having a top wall, a bottom wall, side walls, and front opening doors;

b) within said kitchen cabinet, an upper section and a lower section;

c) said upper section having multiple pull out horizontal drawers, each drawer having a front and rear wall, each said front and rear wall being complementarily sized and shaped and being substantially upstanding, each said front and rear wall being rectangular shaped and having an upper end, a lower end, a first left side, a second right side, an inner surface and an outer surface, a left side wall and a right side wall extending between said front wall and said rear wall, a bottom being disposed in said drawer adapted to store a plurality of containers on said bottom, said bottom being disposed underneath said front, said rear, said left side and said right side walls; a slide mechanism being disposed on each of said left and right side walls of said drawer so that said drawer is slidably disposed in the cabinet; and wherein said drawer is constructed of transparent material and adapted for visual observation of said containers via said bottom;

d) said lower section comprising at least two vertically extending shelf units, each said shelf unit having a front and rear panel, each said front and rear panel being complementarily sized and shaped and being substantially upstanding, each said front and rear panel being rectangular shaped and having an upper end, a lower end, a left side, a right side, an inner surface and an outer surface;

e) a side support panel extending between said front and rear panels of said shelf units, said side support panel having upper and lower ends;

f) in said shelf units, a top panel disposed on said upper end of said front, said rear, and said side support panels, wherein said top panel extends from said front panel to said rear panel and from said first side to said second side of said front and rear panels;

g) in said shelf units, a bottom panel disposed on said lower end of said front, said rear, and said side support panels, wherein said bottom panel extends from said front panel to said rear panel and from said left side to said right side of said front and rear panels, wherein said side support panel and said front and rear panel forms a substantially "C" shaped column when viewed from the top;

h) in said shelf units, at least one individual shelf being disposed on a side of said side support panel between said top and bottom panels so that a plurality of containers are adapted to be stored on said individual shelf, said individual shelf having an outer edge;

i) in said shelf units, a slide mechanism being disposed on each of said left and right sides of said bottom panel so that said shelf unit is slidably disposed in the cabinet;

j) in said lower section, a first stiffener connected on said outer edge of each said individual shelf, wherein said first stiffener extends from said front panel to said rear panel and is directly attached to said front and rear panels, wherein said first stiffener and said individual shelf form a substantially "L" shaped beam on said first side of said front panel when viewed from the front, wherein said first stiffener is effectively high to form a lip to contain said containers on said individual shelf;

k) wherein said front and rear panel, said side support panel, said top and bottom panels and individual shelves are constructed of said transparent material, wherein said containers are adapted to be visually observed through said transparent material prior to sliding out the shelf unit;

l) wherein all of said shelves in both said upper and lower sections are fused to said side walls and said central panels; and m) wherein said front opening doors of said cabinet completely enclose said upper and lower sections when closed.

4. The kitchen cabinet of claim 3, further comprising a second stiffener being disposed on said outer edge of said bottom panel, wherein said second stiffener extends from said front panel to said rear panel, wherein said second stiffener is effectively high to provide a vertical surface to which said slide mechanism can be attached.

5. A method of making a kitchen cabinet, comprising the steps of:

a) providing said kitchen cabinet with a top wall, a bottom wall, side walls, and front opening doors;

b) providing within said kitchen cabinet, an upper section and a lower section;

c) providing said upper section with multiple pull out horizontal drawers, each drawer having a front and rear wall, each said front and rear wall being complementarily sized and shaped and being substantially upstanding, each said front and rear wall being rectangular shaped and having an upper end, a lower end, a first left side, a second right side, an inner surface and an outer surface, a left side wall and a right side wall extending between said front wall and said rear wall, a bottom being disposed in said drawer adapted to store a plurality of containers on said bottom, said bottom being disposed underneath said front, said rear, said left side and said right side walls; a slide mechanism being disposed on each of said left and right side walls of said drawer so that said drawer is slidably disposed in the cabinet; and wherein said drawer is constructed of transparent material, and adapted for visual observation of said containers through said transparent material prior to sliding out the drawer, said containers being visible via said bottom;

d) providing in said lower section at least two shelf units, each shelf unit having a front and rear panel, each said front and rear panel being complementarily sized and shaped and being substantially upstanding, each said front and rear panel being rectangular shaped and having an upper end, a lower end, a left side, a right side, an inner surface and an outer surface;

e) in said shelf units, providing a center support panel extending between the front and rear panels, the center support panel having upper and lower ends, wherein the center support panel and the front and rear panel form a substantially "I" shaped column when viewed from the top;

f) providing in said shelf units a top panel on the upper end of the front, the rear and the center support panels, wherein the top panel extends from the front panel to the rear panel and from the left side to the right side of the front and rear panels;

g) providing in said shelf units a bottom panel disposed on the lower end of the front, the rear, and the center support panels, wherein the bottom panel extends from the front panel to the rear panel and from the left side to the right side of the front and rear panels;

h) providing in said shelf units at least one individual shelf on each side of the center support panel between the top and bottom panels so that a plurality of containers are adapted to be stored on the individual shelf, the individual shelf having an outer edge;

i) providing in said shelf units a slide mechanism on each side of the shelf unit so that the shelf unit is slidably disposed in the cabinet;

j. providing a first stiffener on the outer edge of each individual shelf, wherein the first stiffener extends from the front panel to the rear panel and directly attached to both said front panel and said rear panel, wherein the first stiffener and the individual shelf form a substantially "L" shaped beam on the left side of the front panel when viewed from the front, wherein the first stiffener is effectively high to form a lip to contain the containers on the individual shelf;

k) wherein the front and rear panel, the center support panel, the top and bottom panels and the individual shelves are constructed of said transparent material, wherein the containers are adapted to be visually observed through the transparent material prior to sliding out the shelf unit; and l) wherein all of said shelves in both said upper and lower sections are fused to said side walls and central panels; and m) wherein said front opening doors of said cabinet completely enclose said upper and lower sections when closed.

6. The method of claim 5, further comprising the steps of providing a second stiffener on the outer edge of the bottom panel, wherein the second stiffener extends from the front panel to the rear panel, wherein the second stiffener is effectively high to provide a vertical surface to which the slide mechanism is attached.

7. A method of making a kitchen cabinet, comprising the steps of:

a) providing said kitchen cabinet with a top wall, a bottom wall, side walls, and front opening doors;

b) providing within said kitchen cabinet, an upper section and a lower section;

c) providing said upper section with multiple pull out horizontal drawers, each drawer having a front and rear wall, each said front and rear wall being complementarily sized and shaped and being substantially upstanding, each said front and rear wall being rectangular shaped and having an upper end, a lower end, a first left side, a second right side, an inner surface and an outer surface, a left side wall and a right side wall extending between said front wall and said rear wall, a bottom being disposed in said drawer adapted to store a plurality of containers on said bottom, said bottom being disposed underneath said front, said rear, said left side and said right side walls; a slide mechanism being disposed on each of said left and right side walls of said drawer so that said drawer is slidably disposed in the cabinet; and wherein said drawer is constructed of transparent material, wherein said containers are adapted to be visually observed through said transparent material prior to sliding out the drawer, wherein said containers are adapted to be visually observed via said bottom;

d) providing in said lower section at least two shelf units, each shelf unit having a front and rear panel, each said front and rear panel being complementarily sized and shaped and being substantially upstanding, each said front and rear panel being rectangular shaped and having an upper end, a lower end, a left side, a right side, an inner surface and an outer surface;

e) providing in said shelf units a side support panel extending between the front and rear panels, the side support panel having upper and lower ends;

f) providing in said shelf units a top panel disposed on the upper end of the front, the rear, and the side support panels, wherein the top panel extends from the front panel to the rear panel and from the left side to the second side of the front and rear panels;

g) providing in said shelf units a bottom panel disposed on the lower end of the front, the rear, and the side support panels, wherein the bottom panel extends from the front panel to the rear panel and from the first side to the second side of the front and rear panels, wherein the side support panel and the front and rear panel form a substantially "C" shaped column when viewed from the top;

h) providing in said shelf units at least one individual shelf on a side of the side support panel between the top and bottom panels so that a plurality of containers are adapted to be stored on the individual shelf, the individual shelf having an outer edge;

j) providing in said shelf units a slide mechanism on each side of the shelf unit so that the shelf unit is slidably disposed in the cabinet; and, j) providing a first stiffener being disposed on the outer edge of each individual shelf, wherein the first stiffener extends from the front panel to the rear panel and is directly attached to both front and rear panels, wherein the first stiffener and the individual shelf form a substantially "L" shaped beam on the left side of the front panel when viewed from the front, wherein the first stiffener is effectively high to form a lip to contain the containers on the individual shelf;

k) wherein the front and rear panel, the side support panel, the top and bottom panels and the individual shelves are constructed of said transparent material, wherein the containers are adapted to be visually observed through the transparent material prior to sliding out the shelf unit;

l) wherein all of said shelves in both said upper and lower sections are fused to said side walls and central panels; and m) wherein said front opening doors of said cabinet completely enclose said upper and lower sections when closed.

8. The method of claim 7, further comprising the steps of providing a second stiffener on the outer edge of the bottom panel, wherein the second stiffener extends from the front panel to the rear panel, wherein the second stiffener is effectively high to provide a vertical surface to which the slide mechanism is attached.

* * * * *